US011136802B2

(12) United States Patent
Tsimbikos

(10) Patent No.: US 11,136,802 B2
(45) Date of Patent: Oct. 5, 2021

(54) SEMI-INVISIBLE COMBINATION FOR SLIDING DOORS WHICH ALLOWS THE UNHINDERED PASSAGE

(71) Applicant: ORAMA MINIMAL FRAMES LTD, Loutraki Corinthias (GR)

(72) Inventor: Georgios Tsimbikos, Loutraki Attikis (GR)

(73) Assignee: ORAMA MINIMAL FRAMES LTD, Loutraki Attikis (GR)

( * ) Notice: Subject to any disclaimer, the term of this patent is extended or adjusted under 35 U.S.C. 154(b) by 61 days.

(21) Appl. No.: 16/477,284

(22) PCT Filed: Jan. 15, 2018

(86) PCT No.: PCT/GR2018/000002
§ 371 (c)(1),
(2) Date: Jul. 11, 2019

(87) PCT Pub. No.: WO2018/130862
PCT Pub. Date: Jul. 19, 2018

(65) Prior Publication Data

US 2019/0383078 A1 Dec. 19, 2019

(30) Foreign Application Priority Data

Jan. 13, 2017 (GR) ..... 20170100009

(51) Int. Cl.
*E05D 13/00* (2006.01)
*E05D 15/06* (2006.01)
(Continued)

(52) U.S. Cl.
CPC ..... *E05D 15/0665* (2013.01); *E05D 15/0686* (2013.01); *E05D 15/08* (2013.01);
(Continued)

(58) Field of Classification Search
CPC . E05D 15/0665; E05D 15/0686; E05D 15/08; E05Y 2800/12; E06B 3/04609;
(Continued)

(56) References Cited

U.S. PATENT DOCUMENTS 1,731,801 A 10/1929 Tracy
3,397,487 A * 8/1968 Hunt ..... E06B 3/924 49/130
(Continued)

FOREIGN PATENT DOCUMENTS

CN 201810138 U 4/2011
CN 103210167 A 7/2013
(Continued)

OTHER PUBLICATIONS

EXALCOSYSTEMS: "Orama Minimal Frames—[Sigma] [upsilon] [rho] [omicron] [mu] [epsilon] [nu] [omicron] [sigma] [upsilon] [sigma] [tau] [eta] [mu] [alpha] [mu] [epsilon] [theta] [epsilon] [rho] [mu] [omicron] [delta] [iota] [alpha] [ kappa] [omicron] [pi] [eta]", youtube, Oct. 24, 2016, p. 1, pp. URL:https://www.youtube.com/water?v=NCwMG4zSgQ.
(Continued)

*Primary Examiner* — Jerry E Redman
(74) *Attorney, Agent, or Firm* — Finch & Maloney, PLLC; Michael J. Bujold; Jay S. Franklin

(57) ABSTRACT

A semi-invisible combination of thermal insulating profiles of the lower part of sliding doors and windows which allows the unhindered passage of people and objects above the semi-invisible combination. The interior and exterior floor has co-planarity and uniformity while the invention permits unhindered passage of people and objects, is accessible by people with walking disabilities, has narrow width grooves, has a classy profile design, has high levels of waterproofing
(Continued)

for the non-visible parts as well as high waterproofing against normal weather conditions.

19 Claims, 9 Drawing Sheets

(51) Int. Cl.
*E05D 15/08* (2006.01)
*E06B 3/46* (2006.01)

(52) U.S. Cl.
CPC ..... *E05Y 2800/12* (2013.01); *E06B 3/4609* (2013.01); *E06B 3/4636* (2013.01)

(58) Field of Classification Search
CPC .... E06B 3/4654; E06B 3/4681; E06B 3/4636; E06B 3/487; E06B 3/46; E06B 3/00; E06B 9/00
USPC ..... 49/425
See application file for complete search history.

(56) References Cited

U.S. PATENT DOCUMENTS 4,192,100 A * 3/1980 Klema ..... E05D 15/08 49/125
6,082,050 A * 7/2000 Schilling ..... E06B 3/4609 49/452
6,901,705 B1 * 6/2005 Park ..... E05D 15/0686 49/410
8,176,680 B2 * 5/2012 Chubb ..... E05F 1/16 49/425
8,578,668 B2 11/2013 Joray
8,683,747 B2 * 4/2014 Kim ..... E06B 3/46 49/471
8,739,481 B2 6/2014 Kim
9,080,360 B2 7/2015 Joray
2011/0179718 A1 * 7/2011 Martin ..... E05F 5/003 49/413
2011/0197515 A1 * 8/2011 Joray ..... E06B 3/4609 49/425
2012/0291392 A1 * 11/2012 Joray ..... E05D 15/0682 52/656.5
2015/0033633 A1 * 2/2015 Tarrega Lloret ..... E06B 7/16 49/406
2015/0345198 A1 * 12/2015 Bellei ..... E05D 15/0691 49/414
2015/0354258 A1 * 12/2015 Geysels ..... E04F 21/0023 49/425
2019/0003227 A1 * 1/2019 McCoy ..... E06B 3/4636
2019/0162003 A1 * 5/2019 Ritzi ..... E05D 15/0656
2019/0169921 A1 * 6/2019 De Sousa Guedes ..... E05D 15/0686
2019/0383078 A1 * 12/2019 Tsimbikos ..... E05D 15/0665
2020/0056419 A1 * 2/2020 Lee ..... E06B 3/46
2020/0318419 A1 * 10/2020 Guhl ..... E05D 15/0686
2020/0408016 A1 * 12/2020 Hernandez ..... E06B 7/14
2021/0002936 A1 * 1/2021 McCoy ..... E06B 3/4636

FOREIGN PATENT DOCUMENTS

EP 2093364 A1 8/2009
EP 2429874 A1 3/2012
EP 2 525 033 A1 11/2012
EP 2525033 A1 11/2012

OTHER PUBLICATIONS

International Search Report Corresponding to PCT/GR2018/000002 dated Apr. 18, 2018.
Written Opinion Corresponding to PCT/GR2018/000002 dated Apr. 18, 2018.
Chinese Office Action issued in corresponding Chinese Patent Application No. 201880006229.2 dated Jun. 1, 2020.
Chinese Search Report issued in corresponding Chinese Patent Application No. 201880006229.2 dated May 26, 2020.

* cited by examiner

SEMI-INVISIBLE COMBINATION FOR SLIDING DOORS WHICH ALLOWS THE UNHINDERED PASSAGE

TECHNICAL FIELD

The present invention relates to a semi-invisible combination of thermal insulating profiles of the lower part of sliding doors and windows which allows the unhindered passage of people and objects above it, the positioning of the invention allows the flatness and uniformity of indoor and outdoor floor coverings as well as the creation of small width grooves on the floor, which consists of the following:

Of at least one thermal insulating profile (1) with one or more movement grooves which is firmly attached to the structural components of the building and which is called "Frame" (1)

Of at least one thermal insulating profile from PVC or Polyamide (3) which is called "sash" and which is equipped with the appropriate U shaped channels (18) in order to receive heat insulating panels or glazing. (19)

Of at least one tubular thermal insulating profile or assembly of insulating or not profiles which is called "added horizontal support" (2), connected to the "sash" (3) in such way which allows the linear contractions and expansions, whom cavities (33*a*), (33*b*), (33*c*) and (33*d*) can potentially be filled, with heat insulating materials or reinforced profiles. Moreover the "added horizontal support" (2) comprises from wheels (20*a*), (20*b*) and (20*c*) which in cooperation with the sidewalls (28*a*) & (28*b*) of the movement grooves (25) & (25*a*), align the bended longitudinal profiles caused by the contact with a bended "sash" (3) and bended glazing (19). This bending is caused due to temperature difference of the interior with the exterior environment.

STATE OF THE ART

Over the last couple of years there were developed many semi-invisible or invisible combinations of thermal insulating profiles for sliding doors and windows, with acceptable application for the roof and vertical elements of the "frame". These innovations had some limitations such as: insufficient insulation of the hidden parts of the doors and windows, cold liquefaction zones in the visible part of the window, no possibility of extending, stabilizing and aligning the floor attached to the frame, lack of waterproofing, floors which were internally and externally not coplanar, no regards or taking into consideration people using wheelchair or in use of walking aid. Moreover these types of framing do not support easily replaced glazing but only via dismantling part of the floor. Furthermore, the complexity of the sliding mechanisms become dysfunctional over the years especially the rollers, as they are attached at the "frame" and not at the "sash". In addition to the above, the temperature difference between indoor and outdoor environment is not widely taken into consideration therefore the expansion and contraction of the elements used is not efficiently addressed, leading to non-operational curving of the profiles and to limited choices of glazing for the horizontal elements of the "sash". The aim of this invention is to provide a solution to the above mentioned issues.

DISCLOSURE

One of the advantages of this invention is that the combination of thermal insulating profiles of the lower part for sliding doors and windows is semi-invisible and enclosed in the structural components of the building, increasing the visibility and the luminosity of the Interiors. This invention allows elderly people, people with wheelchairs, people using a walking aid with reduced mobility, children to move without facing any protruding surfaces. Moreover, the movement of objects even if they are mounted on wheels or not, is not impaired. The support profiles (7*a*), (7*b*), (8*a*), (8*b*), (8*c*) are vertically adjusted on the "frame" (1) and integrate coplanar the internal and external floor for easy access of people or moving objects. The present invention achieves the optimization of the thickness of permissible vertical thermal insulation zone (27), as well as liquefaction zones are non-existent, as it is centered on the vertical axis (31) of the combination of the thermal insulating profiles "frame" (1), "added horizontal support" (2), "sash" (3). The grooves on the floor (25), (25*a*) that allow the movement of the "sash" (3) and "added horizontal support" (2), have the acceptable length and depth, but narrow width dimension (D), for aesthetic and safety reasons to avoid accidents. The invention configured in this way also provides glazing replacing without dismantling the floor as well as placing the "sash" (3) after the placement of the floor. The sliding rollers (22) are inside sockets (23) within "added horizontal support" (2) and protected from external factors such as chemical cleaning and resilient in time corrosion. Since the sliding rollers are inside these sockets (23) and due to the mirroring inclination of the seating points (24), the counterforces lead to stabilization of the support base (22*a*) as well as of all moving parts. Ball bearings (22*b*) have U-form grooves at the contact point (22*d*), cooperating with cylindrical stainless guide (6*a*), (6*b*), (6*c*), (6*d*), in order to avoid sideways movement due to wind. The "sash" (3) in this invention are designed that way that prohibit access to foreign objects, humidity or air to enter to the interiors due to quadruple zone of waterproofing (13*a*), (13*b*), (13*c*), (13*d*). Moreover the semi visible part of thermal insulating "sash" profile (3) according to clients' needs, can be covered by aluminum profile (4*d*), (4*c*). This extra aluminum profile that can be placed for aesthetic reasons optionally can be colored with electrostatic paint RAL. The current invention allows the "sash" (3) and the "added horizontal support" (2) to slide between them in order to avoid the "bimetallic strip phenomenon".

The wheels (20*a*), (20*b*) and (20*c*) which roll on the side walls (28*a*), (28*b*) of the movement grooves (25) & (25*a*) align bended profiles, therefore the sliding of the moving parts is unhindered. The current invention is compatible with all energy and security glazing types.

BRIEF

DETAILED

Figure 1:
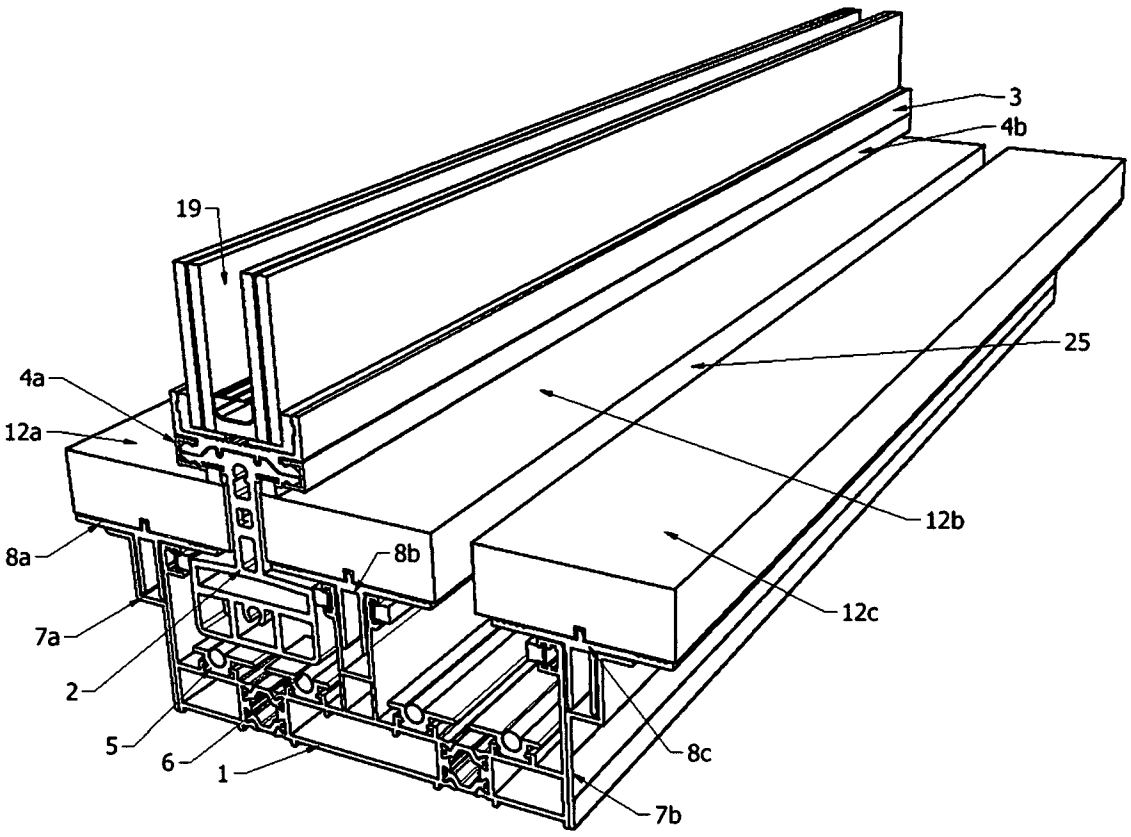
FIG. 1 is a perspective view of the lower horizontal part of the sliding door and window where the following can be seen: the two grooves (25), the "frame" (1) with it's two movement channels (34), the support profiles (8*a*), (8*b*), (8*c*), the "sash" (3) with the "added horizontal support" (2), the glazing (19) as well as the U shaped channels (18).
Figure 2:
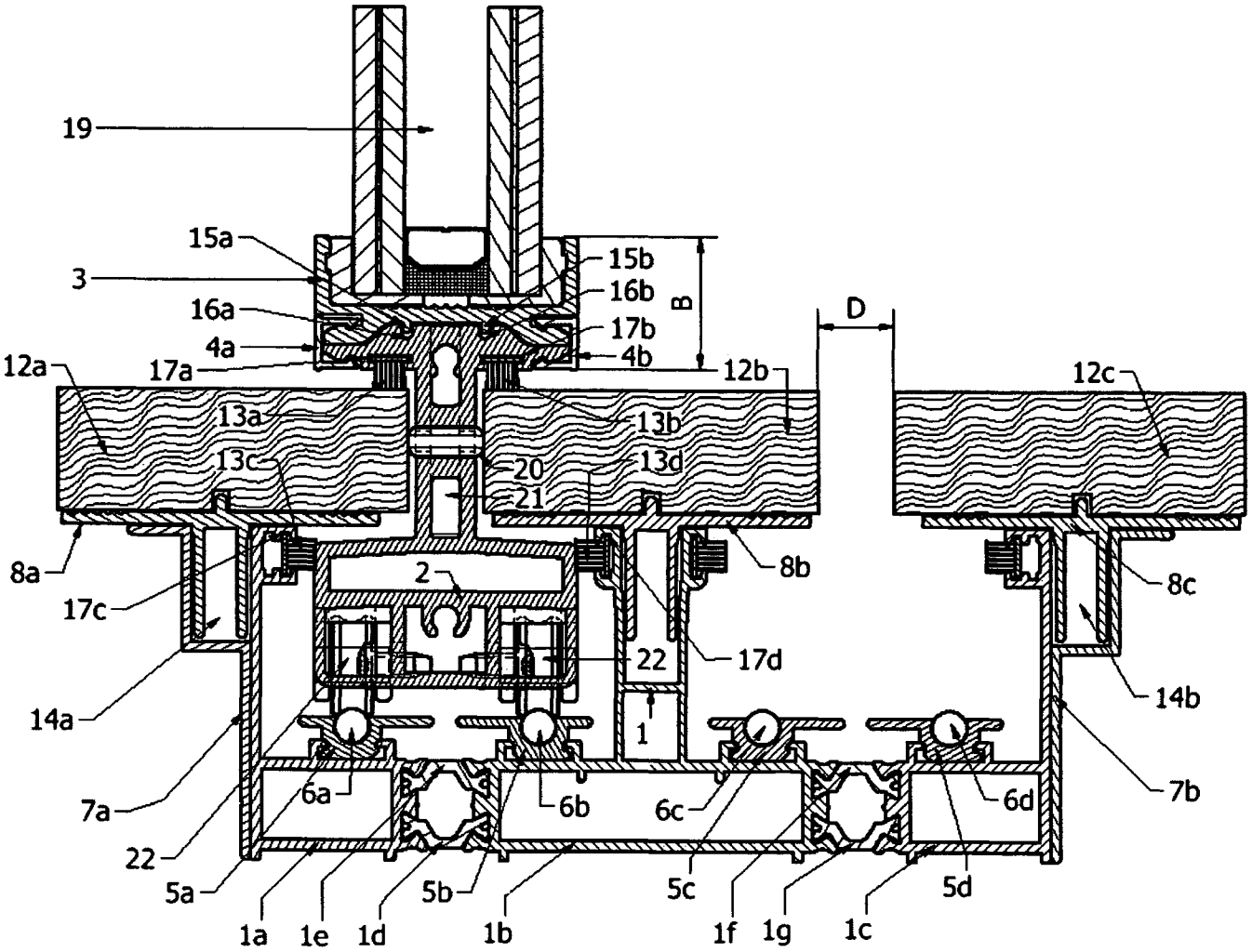
FIG. 2 is a vertical section showing the combination of thermal insulating profiles of its lower horizontal part.
Figure 3:
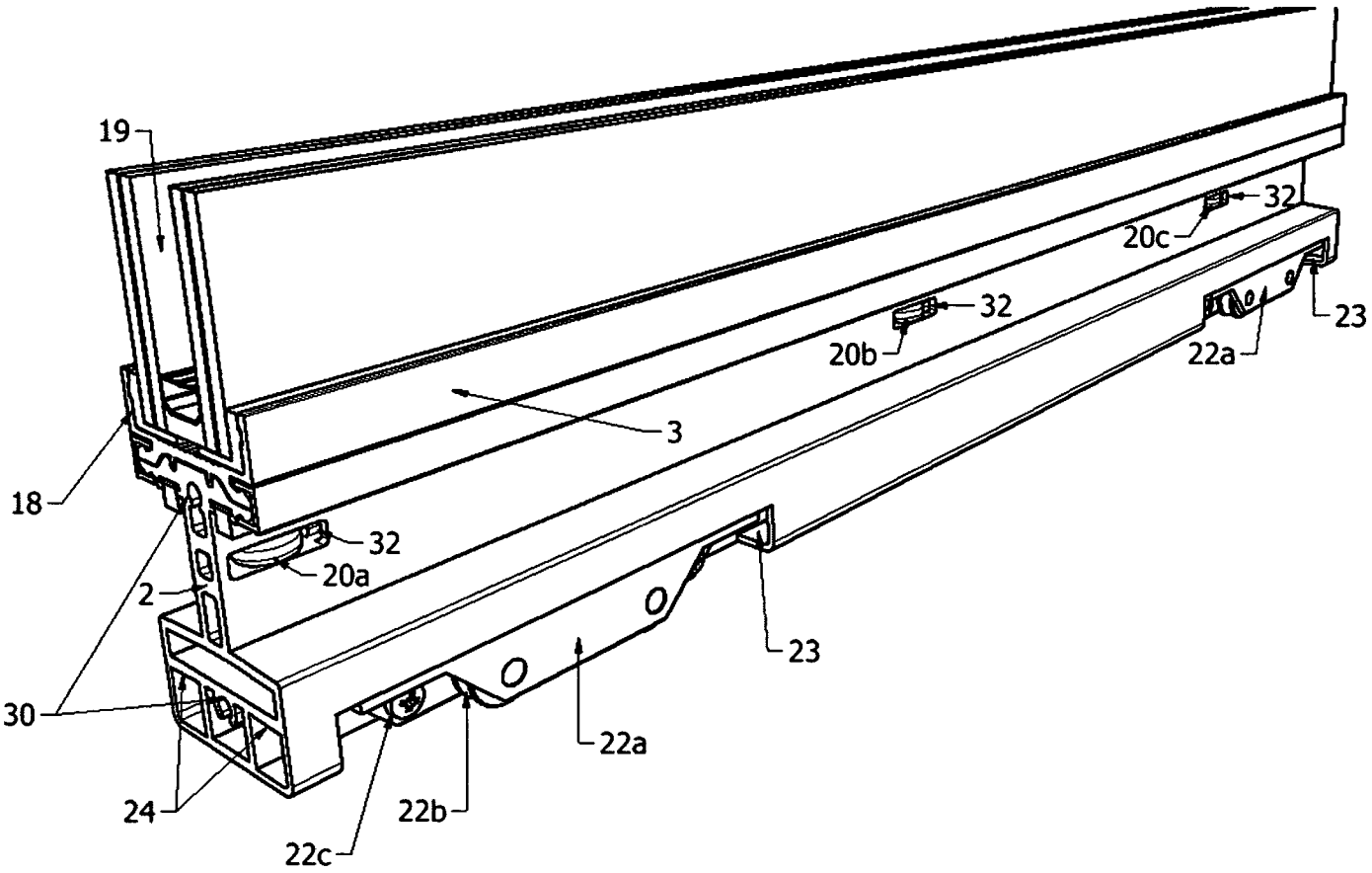
FIG. 3 is a perspective view that shows the "sash" (3), the "added horizontal support" (2), the glazing (19), the wheels (20*a*), (20*b*), (20*c*) placed in the sockets (32), as well as the rollers (22) placed in their sockets (23).
Figure 4:
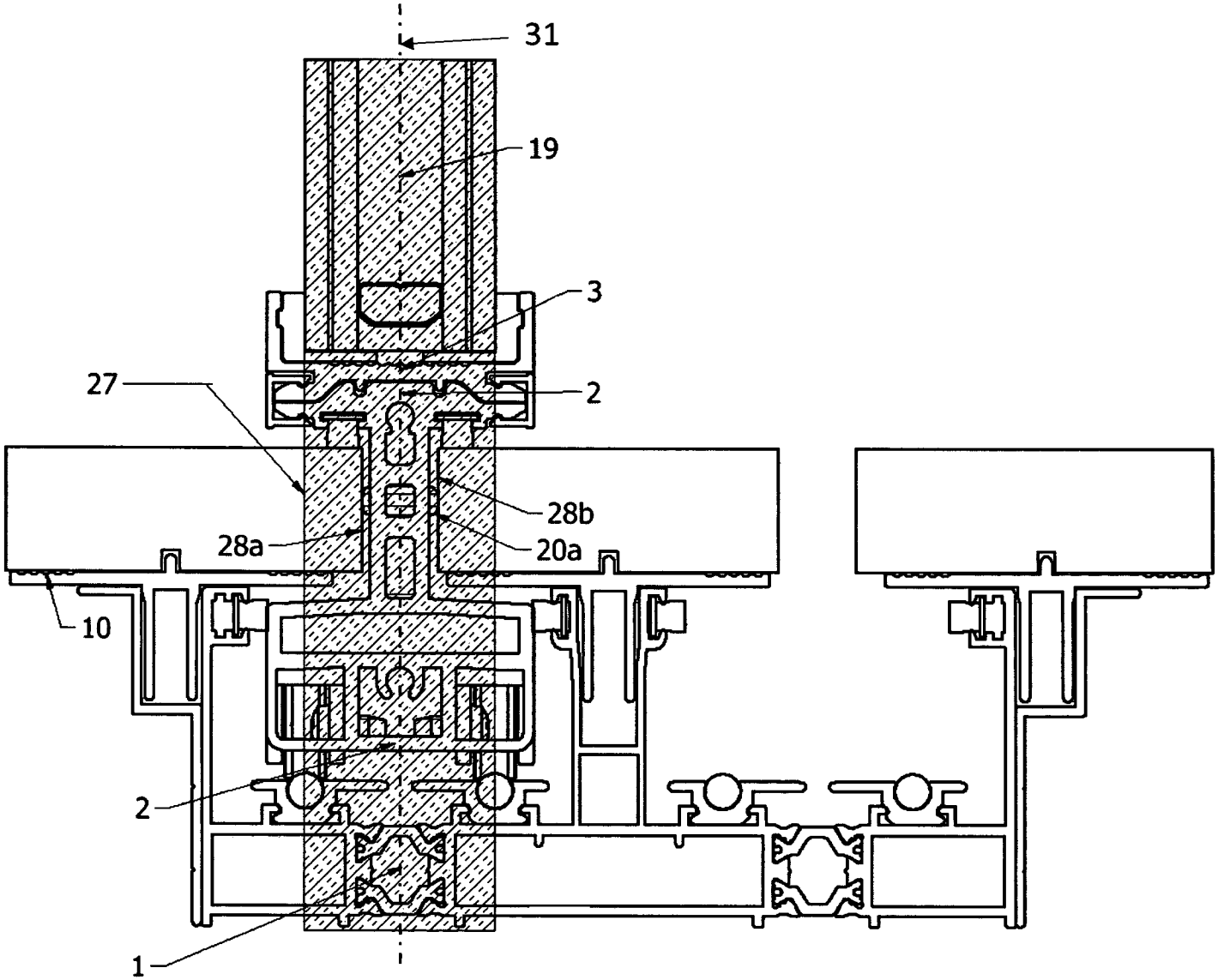
FIG. 4 shows the thermal insulating zone and how it is placed in accordance to the vertical axis (31) without any deviation from the axis, as it is known that thermal insulation must be in a straight line in order to achieve optimum coefficient of thermal transmittance.
Figure 5:
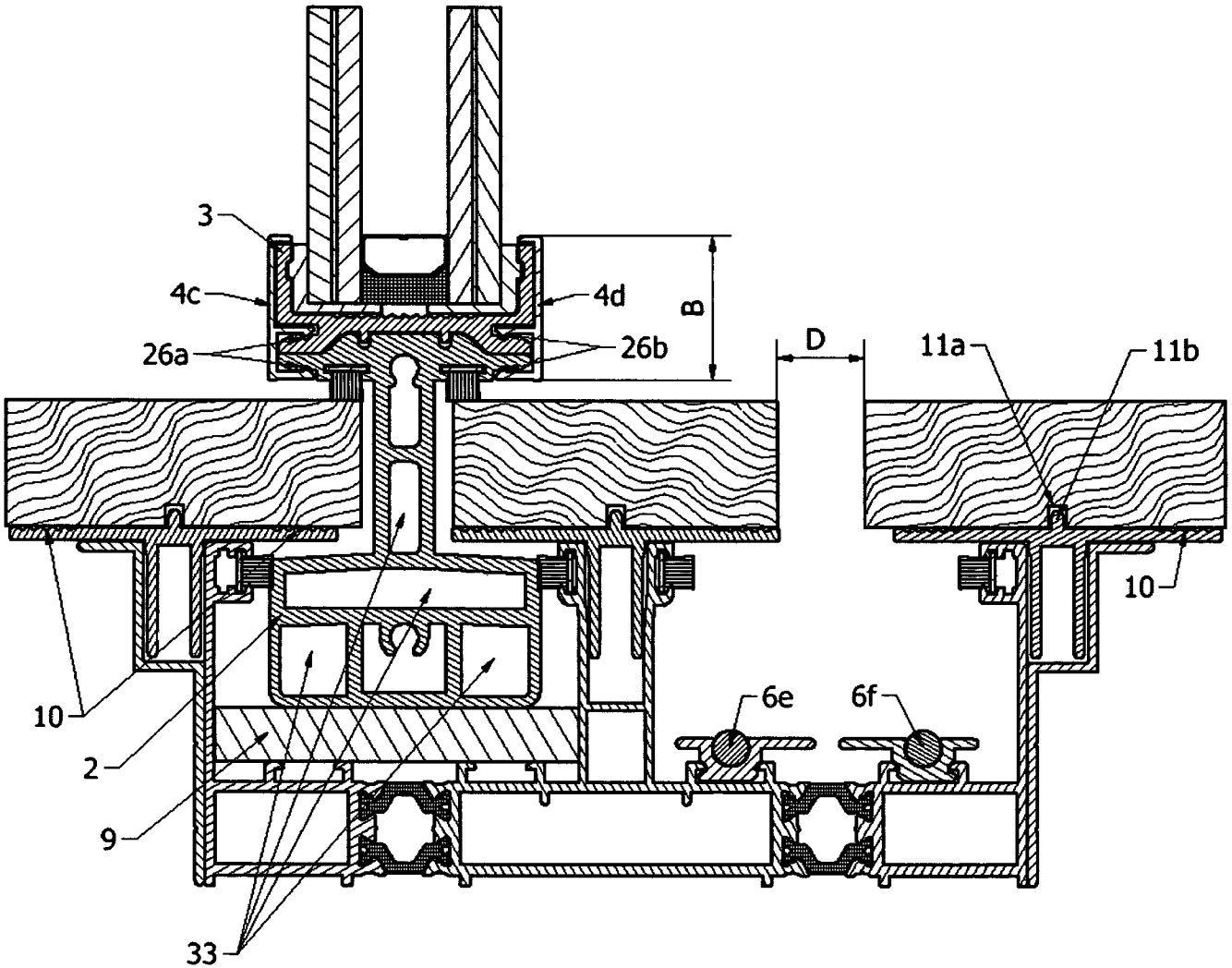
FIG. 5 shows a fixed "sash" (3) cooperating with the thermal insulating profiles of the "added horizontal support" (2) and the "frame" (1), the glazing (19) and the spacer part (9).
Figure 6:
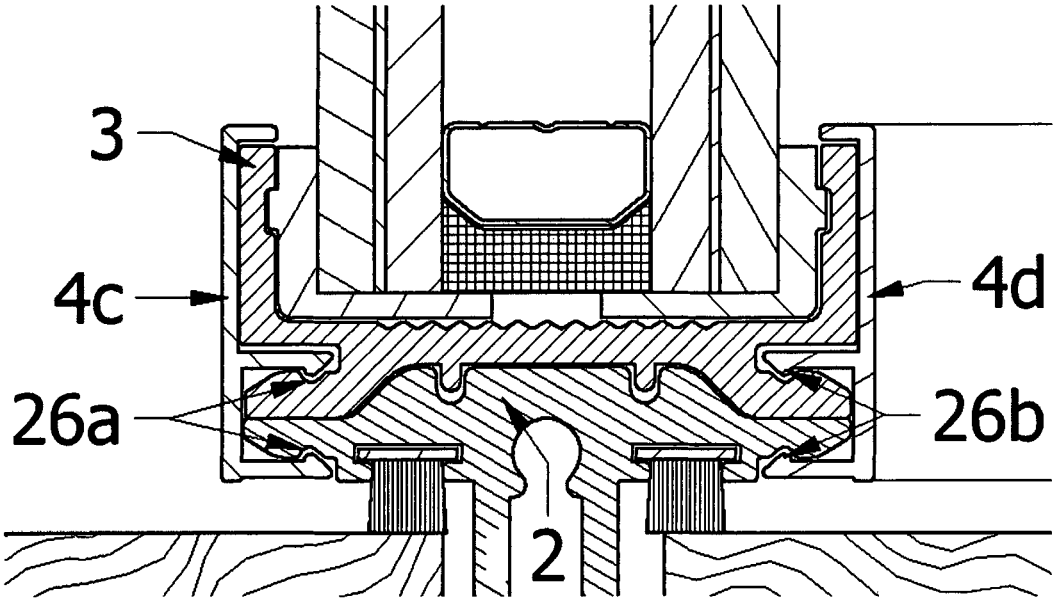
FIG. 6 shows the cooperation and the connection between the "sash" (3), the "added horizontal support" (2) and the "Π" shaped profiles (4*c*), (4*d*) which cover the thermal insulating profiles (3) & (2).
Figure 7:
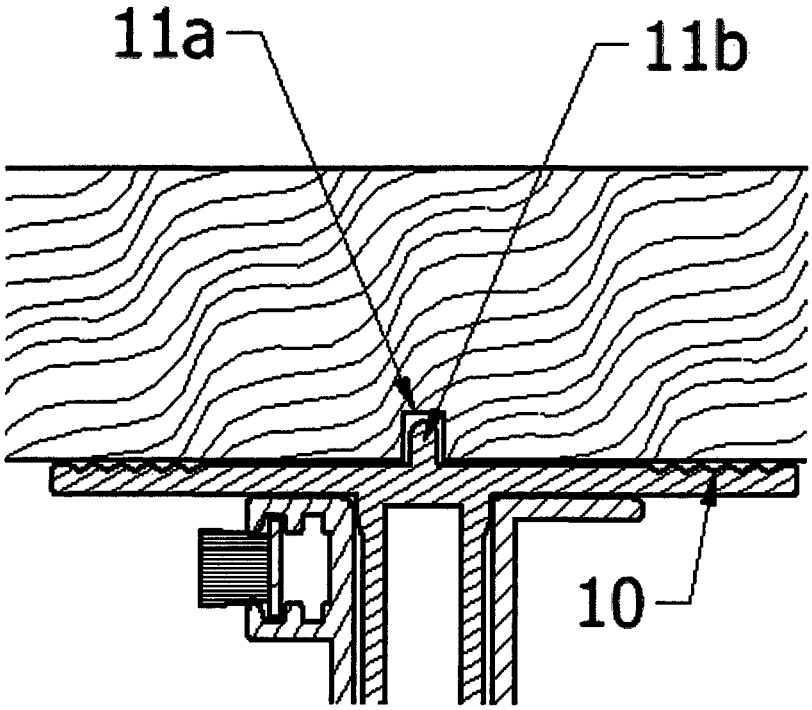
FIG. 7 shows the cavity (11*a*) and the projection (11*b*)
Figure 8:
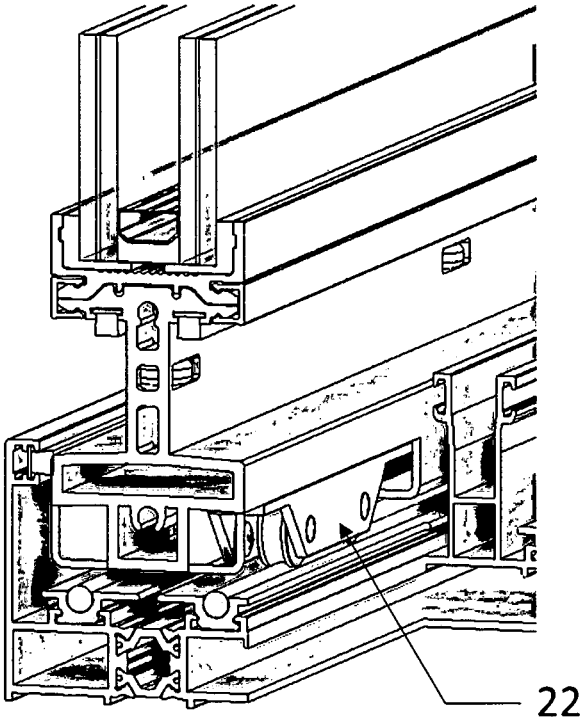
FIGS. 8, 9 show two perspective views of the sockets where the rollers (22) are being placed as well as the inclination surfaces (24).
Figure 9:
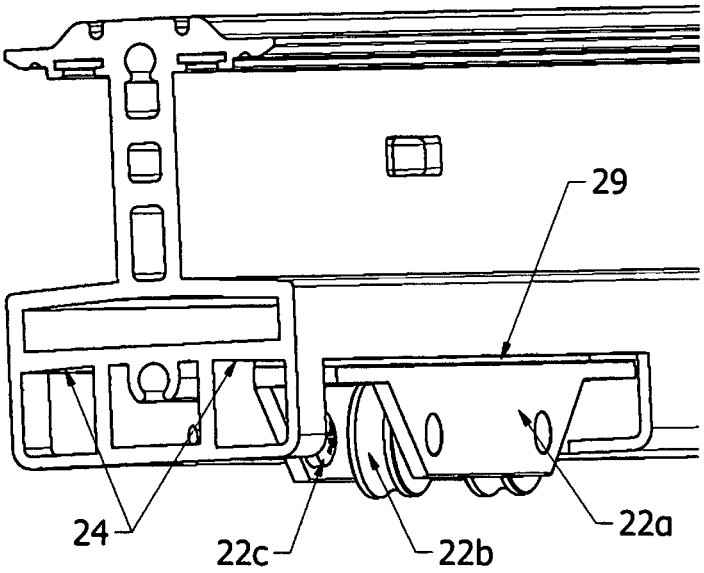

The semi-invisible combination of thermal insulation profiles of the lower part of sliding doors and windows which allows the unhindered passage of people and objects above it, as a set, consists from three parts as below:

a) from at least one thermal insulating profile, firmly attached to the structural components of the building, which is called "frame" (1) The "frame" (1) is a thermal insulating profile, having at least one movement groove (34) which is firmly attached to the structural components of the building, is a constructed set of some aluminum profiles (1*a*), (1*b*), (1*c*) and some polyamide profiles (1*d*), (1*e*), (1*f*), (1*g*) crimped, as indicated by European and global standards. At FIG. 2 a two movement grooves (34) "frame" (1) is crimped as one profile. Moreover at the "frame" (1) there are adjusted as rails, two per movement groove (34), aluminum profiles (5*a*), (5*b*), (5*c*) and (5*d*) that are firmly attached to the "frame" (1), In addition to the above, the aluminum profiles (5*a*), (5*b*), (5*c*) and (5*d*) have embedded cylindrical stainless steel profiles (6*a*), (6*b*), (6*c*), (6*d*), in which the rollers (22) are sliding. At FIG. 5 there can be seen a two movement grooves (34) "frame" (1), one with a fixed "sash" (3) and one movement groove with two rails from cylindrical stainless steel profiles. Spacer parts (9) of parallelepiped shape are adjusted, at the appropriate points of the "frame" (1), in order for the fixed profiles to be placed.

b) from at least one thermal insulating profile, parallel to the floor, made from PVC or from strengthened polyamide, which is called "sash" (3) and it is equipped with the appropriate U shaped channels (18) in order to receive thermal insulating panels or glazing (19). The bottom side of the "sash" (3) has concave sockets (26*a*) and projections (15*b*) in order to cooperate with the profile (4*a*), (4*b*), (4*c*) and (4*d*) and profile (2) respectively. In all figures except FIGS. 7 and 9 the "sash" (3) can be seen as well as its collaboration with the other elements of this invention. The moving sash profiles as well as the fixed, are the same.

c) from at least one tubular thermal insulating profile (2) placed parallel to the floor, made from polyester or polyamide, which incorporate or not fiberglass produced with pultusion or extrusion method or an assembly of thermal insulating or not profiles, is called "added horizontal support" (2). Inside the cavities (33) of the tubular thermal insulating profile (2), materials such as polyurethane, Nanogel etc. can be used for the improvement of the coefficient of thermal transmittance. Alternatively inside these cavities reinforcement profiles can be used to improve the static and dynamic resistance of the profile. The "added horizontal support" (2) is machined (23) and (32), so that the rollers (22) and the wheels (20*a*), (20*b*) and (20*c*) to be placed. Setting of the wheels needs drilling at the "added horizontal support" (2) in order to place their axis (21). At specially shaped cavities (30) of the "added horizontal support" (2) plugs are placed and the vertical elements of the "sash" (3) that surrounds the glazing (19) of the sliding door and window. The 2D and 3D FIGS. 2,3,8,9 and 10 show the machining and the positioning points.

Combination of the above thermal insulating profiles for sliding doors and windows is enclosed at the floor openings, allowing to at least one "sash" (3) and one "added horizontal support" (2) to slide. The visible elements above the floor, have dimension (D) less than 22 mm.

The "added horizontal support" (2) attached to the "sash" (3) are two independent profiles that slide one on the other, contract and expand without the one loading the other caused by material and temperature difference. The wheels (20*a*), (20*b*), (20*c*) that are placed at the "added horizontal support" (2) corrects the curvature of the "sash" (3) and therefore helps to the functionality of movement. The part of the "added horizontal profile" (2) which is placed between the sidewalls (28*a*) and (28*b*) is narrower dimension (C) from the rest of the profile dimension (E). The narrow main body dimension (C) of the "added horizontal support" (2) allows the movement grooves (25*a*) on the floor to have width with (D) dimension less than 16 millimeters. Support profiles (7*a*), (7*b*) are screwed or riveted at the "frame" (1). Moreover the floor support profiles (8*a*), (8*b*), (8*c*), (8*e*), and (8*f*) are glued to the structural components and are placed at the sockets (14*a*), (14*b*). At point number (10) glue should be placed at the grooves.

Figure 10:
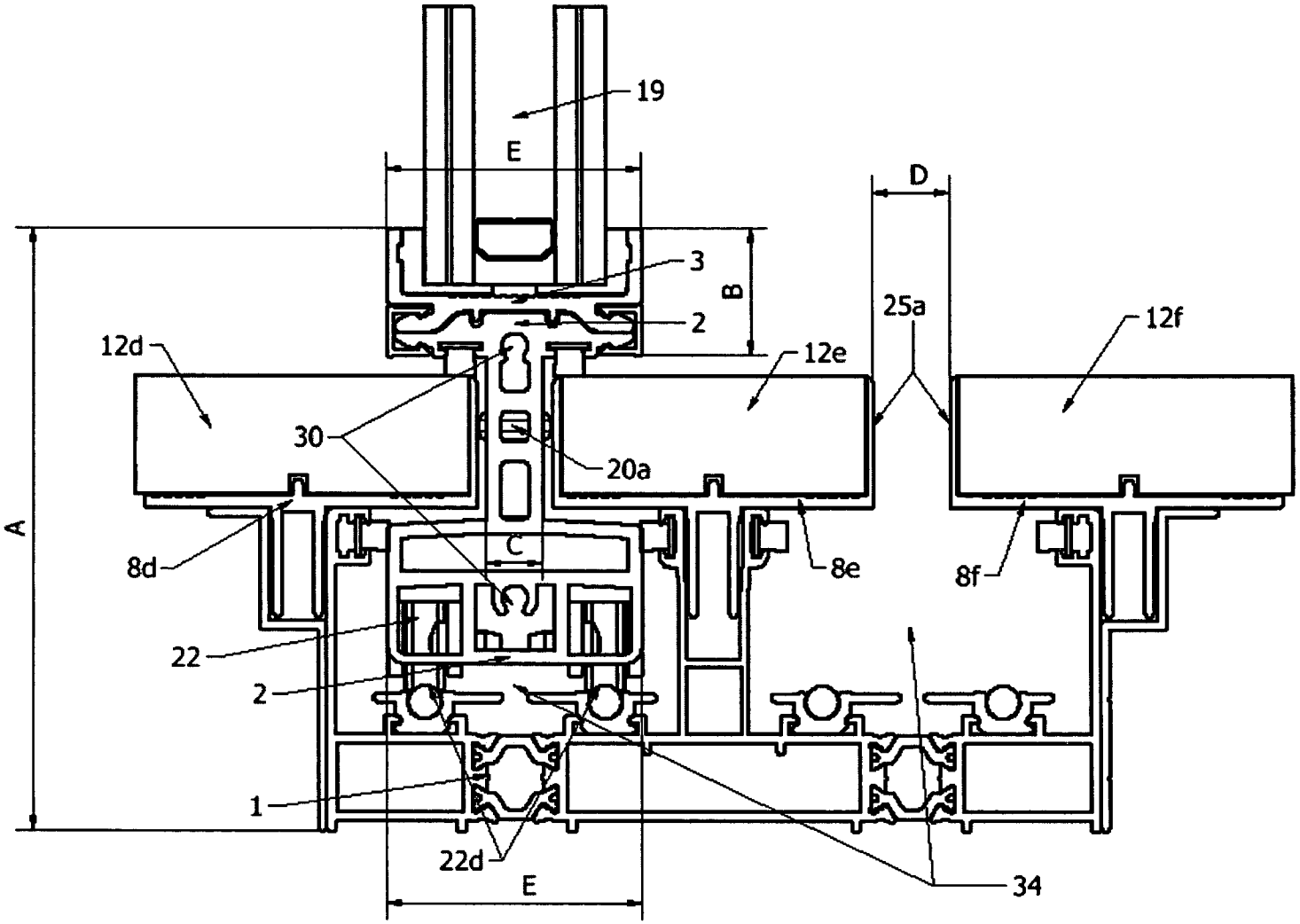
FIGS. 10, 11 shows a vertical section and a perspective view respectively, that show the combination of all thermal insulating profiles cooperating with the support profiles (8*d*), (8*e*), (8*f*) which have angular extensions (25*a*).
Figure 11:
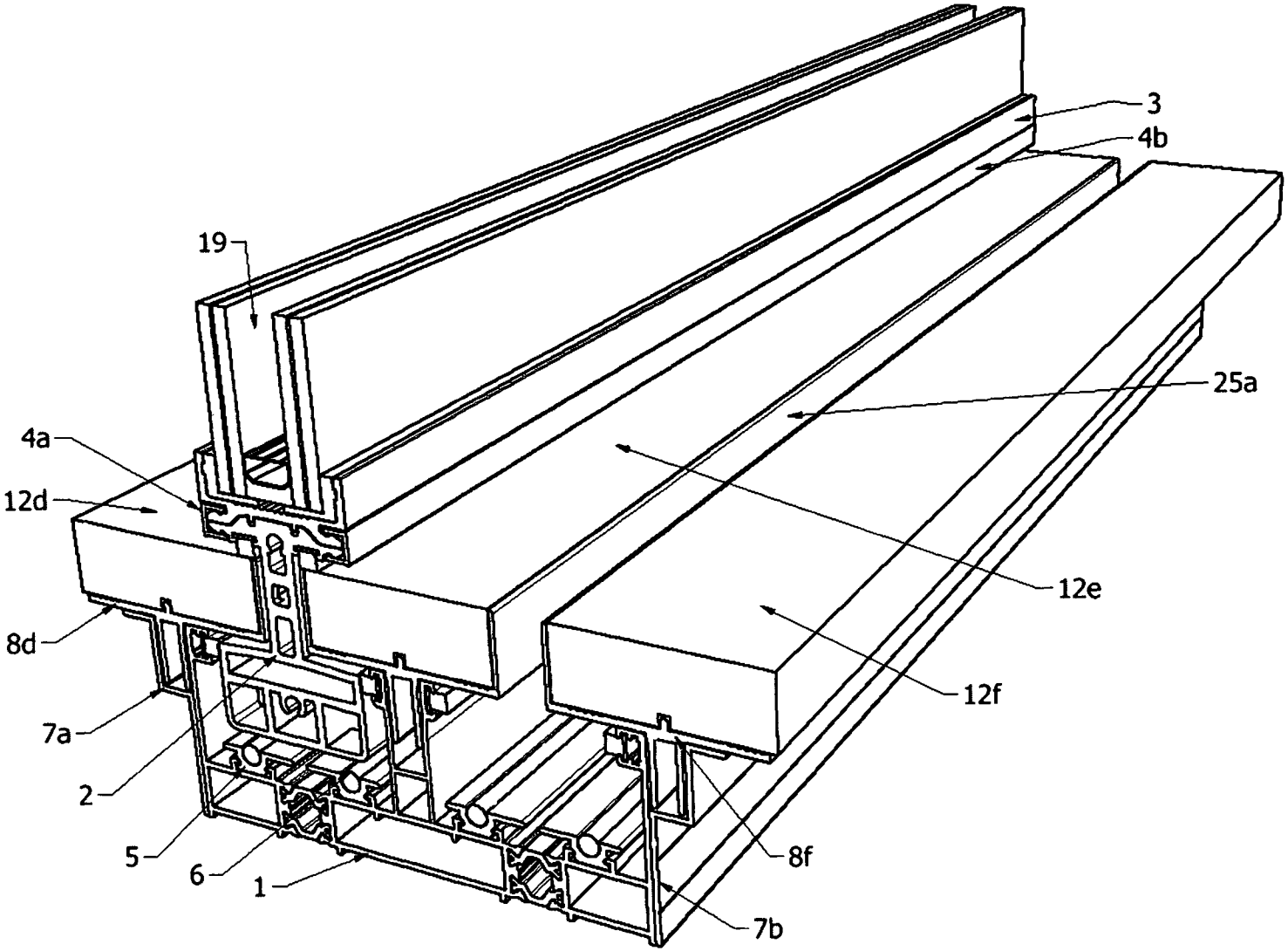

The support profiles (8*a*), (8*b*), (8*c*) of the floor (12*d*), (12*e*), (12*f*) have angular extension (8*d*), (8*e*), (8*f*) which covers the sidewalls (28*a*) and (28*b*) of the grooves (25) and creates new sidewalls (25*a*) in order to provide uniformity and linear alignment. FIG. 10, 11 show the application of the angular support profiles (8*d*), (8*e*) and (8*f*).

The invention claimed is:

1. A partially visible combination of thermal insulating profiles of a lower part of sliding doors and windows which allows the unhindered passage of people and objects above at least one groove formed in a floor comprising:

a) at least one thermal insulating profile forming a frame firmly attached to structural components of a building;

b) at least one thermal insulating profile forming a sash (3) which is made from PVC or strengthened Polyamide and which is equipped with at least one U-shaped channel (18) in order to be able to receive at least one heat insulating panel or glazing (19); and c) at least one tubular thermal insulating profile forming a horizontal support (2) and being manufactured from Polyamide or Polyester;

wherein, following installation, the sash (3) and a vertically upper portion of the horizontal support are visible above the floor having the at least one groove, at least the horizontal support (2) and the sash (3) slide along the at least one groove (34), (25), the frame (1) and a vertically lower portion of the horizontal support (2) are located vertically below the floor, and the horizontal support (2) and the sash (3) are manufactured separately but are joined together by a connecting profile (4), and the horizontal support (2) has sockets (23) in which rollers (22) are placed.

2. The partially visible combination of thermal insulating profiles of the lower part of sliding doors and windows which allows the unhindered passage of people and objects above the at least one groove formed in the floor according to claim 1, wherein the thermal insulating profile frame (1) comprises from at least one groove (34).

3. The partially visible combination of thermal insulating profiles of the lower part of sliding doors and windows which allows the unhindered passage of people and objects above the at least one groove formed in the floor according to claim 1, wherein a width (C) of a middle part of horizontal support (2) is smaller than a width (E) of a part of the horizontal support (2) which is above and below the floor.

4. The partially visible combination of thermal insulating profiles of the lower part of sliding doors and windows which allows the unhindered passage of people and objects above the at least one groove formed in the floor according to claim 1, wherein support profiles (7*a*) , (7*b*) from one or both sides, are screwed; or riveted to the frame (1) to achieve alignment, co-planarity, support and extension of the structural components (12*a*), (12*b*), (12*c*), (12*d*), (12*e*) and (12*f*) of interior and exterior of the tangential floor via the support aluminum profiles (8*a*), (8*b*), (8*c*), (8*d*), (8*e*) and (8*f*), placed at the receivers (14*a*), (14*b*).

5. The partially visible combination of thermal insulating profiles of the lower part of sliding doors and windows which allows the unhindered passage of people and objects above the at least one groove formed in the floor according to claim 1 wherein a thermal insulating zone (27) is a vertical extension of the insulating panel or glazing (19) and boundaries of the thermal insulating zone (27) are centered with respect to a vertical mid-axis (31).

6. The partially visible combination of thermal insulating profiles of the lower part of sliding doors and windows which allows the unhindered passage of people and objects above the at least one groove formed in the floor according to claim 1, wherein the horizontal support (2) and the sash (3) are connected via the projections (26*b*), (15*a*), (15*b*) and cavities (26*a*), (16*a*), (16*b*) respectively after pressure is applied longitudinally at ⊓-shaped connection points (4*a*), (4*b*), (4*c*) and (4*d*) of the connecting profile (4).

7. The partial visible combination of thermal insulating profiles of the lower part of sliding doors and windows which allows the unhindered passage of people and objects above the at least one groove formed in the floor according to claim 1, wherein the connection between the horizontal support (2) and the sash (3) allows the profiles to slide between them due to contraction and expansion longitudinally on the axis.

8. The partially visible combination of thermal insulating profiles of the lower part of sliding doors and windows which allows the unhindered passage of people and objects above the at least one groove formed in the floor according to claim 1, wherein the visible part above the floor has a dimension (B) less than 22 mm.

9. The partially visible combination of thermal insulating profiles of the lower part of sliding doors and windows which allows the unhindered passage of people and objects above the at least one groove formed in the floor according to claim 1, wherein the frame and the horizontal support (2) have channels (17*a*), (17*b*), (17*c*) and (17*d*), in which waterproofing materials (13*a*), (13*b*), (13*c*), (13*d*), Q-Ion or gaskets can be placed.

10. The partially visible combination of thermal insulating profiles of the lower part of sliding doors and windows which allows the unhindered passage of people and objects above the at least one groove formed in the floor according to claim 1 wherein the rollers (22) are adjusted by an addition or removal of spacers (9).

11. The partially visible combination of thermal insulating profiles of the lower part of sliding doors and windows which allows the unhindered passage passing of people and objects above the at least one groove formed in the floor according to claim 1, wherein the horizontal support (2) has one wheel (20*a*) rotating on a vertical axis (21) placed on at least one cavity (32).

12. The partially visible combination of thermal insulating profiles of the lower part of sliding doors and windows which allows the unhindered passage of people and objects above the at least one groove formed in the floor according to claim 1, wherein the horizontal support (2) have embedded cavities (30) for placement with screws or pins of waterproofing caps at ends of the profile or combination of profiles.

13. The partially visible combination of thermal insulating profiles of the lower part of sliding doors and windows which allows the unhindered passage of people and objects above the at least one groove formed in the floor according to claim 1, wherein the support profiles (8*a*), (8*b*) and (8*c*) have embedded linear, longitudinal cavities cooperating with projections (10) at edge of the profiles.

14. The partially visible combination of thermal insulating profiles of the lower part of sliding doors and windows which allows the unhindered passage of people and objects above the at least one groove formed in the floor according to claim 1, wherein an inclined upper side of the support base (22*a*) of the rollers (22), cooperate with the horizontal support (2) which also inclines (24) with the same angle at their contact point.

15. The partially visible combination of thermal insulating profiles of the lower part of sliding doors and windows which allows the unhindered passage of people and objects above the at least one groove formed in the floor according to claim 1, wherein the horizontal support has two mirror inclinations (24), along a length of the profile or profiles.

16. The partially visible combination of thermal insulating profiles of the lower part of sliding doors and windows which allows the unhindered passage of people and objects above the at least one groove formed in the floor according to claim 1, wherein ball bearings (22*b*) have U form grooves at a contact point (22*d*), cooperating with a cylindrical stainless guide (6*a*), (6*b*), (6*c*) and (6*d*).

17. The partially visible combination of thermal insulating profiles of the lower part of sliding doors and windows which allows the unhindered passage of people and objects above the at least one groove formed in the floor according to claim 1, wherein the support profiles (8*a*), (8*b*), (8 *c*) of the floor (12*a*), (12*b*) and (12*c*) having angular extension (8*d*), (8*e*), (8*f*) to the groove (25) sidewalls (28*a*), (28*b*) and create new aluminum sidewalls (25*a*).

18. A partially visible combination of thermal insulating profiles of a lower part of sliding doors and windows which allows the unhindered passage of people and objects above at least one groove formed in a floor comprising:

a) at least one thermal insulating profile forming a frame firmly attached to structural components of-a building;

b) at least one thermal insulating profile forming a sash which is made from PVC or strengthened Polyamide and which is equipped with at least one U-shaped channel in order to be able to receive at least one heat insulating panel or glazing; and c) at least one tubular thermal insulating profile forming a horizontal support and being manufactured from Polyamide or Polyester;

wherein, following installation, the sash and a vertically upper portion of the horizontal support are visible above the floor having the at least one groove, at least the horizontal support and the sash slide along the at least one groove, the frame and a vertically lower portion of the horizontal support are located vertically below the floor, the frame supports a pair of cylindrical profiles and a vertically downward facing surface of the horizontal support supports at least a pair of rollers which respectively engage with the pair of cylindrical profiles and facilitate sliding movement of the sash and the horizontal support along the at least one groove relative to the frame, and the horizontal support and the sash are manufactured separately but are joined together by a connecting profile.

19. A partially visible combination of thermal insulating profiles of a lower part of sliding doors and windows which allows the unhindered passage of people and objects above at least one groove formed in a floor comprising:

a) at least one thermal insulating profile forming a frame firmly attached to structural components of-a building;

b) at least one thermal insulating profile forming a sash which is made from PVC or strengthened Polyamide and which is equipped with at least one U-shaped channel in order to be able to receive at least one heat insulating panel or glazing; and c) at least one tubular thermal insulating profile forming a horizontal support and being manufactured from Polyamide or Polyester;

wherein, following installation, the sash and a vertically upper portion of the horizontal support are visible above the floor having the at least one groove, at least the horizontal support and the sash slide along the at least one groove, the frame and a vertically lower portion of the horizontal support are located vertically below the floor, the frame supports a pair of cylindrical profiles and a vertically downward facing surface of the horizontal support supports at least a pair of rollers which respectively engage with the pair of cylindrical profiles and facilitate sliding movement of the sash and the horizontal support along the at least one groove relative to the frame, at least one cavity is formed in the horizontal support and the at least one cavity is filled with an insulating material to improve a coefficient of thermal transmittance of the horizontal support, and the horizontal support and the sash are manufactured separately but are joined together by a connecting profile.

* * * * *